US007240531B2

(12) United States Patent
Turnbull et al.

(10) Patent No.: US 7,240,531 B2
(45) Date of Patent: Jul. 10, 2007

(54) PRESS FOR FORMING CONTAINERS WITH PROFILED BOTTOMS

(75) Inventors: Robert D. Turnbull, Massillon, OH (US); Barry Lippert, Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 168 days.

(21) Appl. No.: 11/067,169

(22) Filed: Feb. 25, 2005

(65) Prior Publication Data

US 2006/0191310 A1 Aug. 31, 2006

(51) Int. Cl.
*B21D 22/00* (2006.01)
*B21D 22/21* (2006.01)

(52) U.S. Cl. ..... 72/348; 72/347; 72/379.4

(58) Field of Classification Search ..... 72/336, 72/347–348, 379.4
See application file for complete search history.

(56) References Cited

U.S. PATENT DOCUMENTS 4,620,434 A * 11/1986 Pulciano et al. ..... 72/347
4,696,177 A 9/1987 Bulso, Jr. et al. ..... 72/379
4,732,031 A 3/1988 Bulso, Jr. et al. ..... 72/363
4,826,382 A 5/1989 Bulso, Jr. et al. ..... 413/69
5,024,077 A 6/1991 Bulso, Jr. et al. ..... 72/336
5,881,593 A 3/1999 Bulso, Jr. et al. ..... 72/336

* cited by examiner

*Primary Examiner*—Derris H. Banks
*Assistant Examiner*—Teresa M. Bonk
(74) *Attorney, Agent, or Firm*—David P. Maivald; Eckert Seamans Cherin & Mellott, LLC

(57) ABSTRACT

A press for forming a container with a bottom profile is provided. The press may have a profile pad that is secured within a base of the press or is secured to a die core riser that is axially movable up and down. The press may have one or more biasing members that accommodate expansion in certain tooling components during operation of the press. The press may have a tool pack of tool components located within a part of the fixed base wherein the tool pack is removable from a top surface of the base. The press may have a punch and a profile pad with an annular projection or an annular shoulder wherein the projection and the shoulder clamp material between the projection and the shoulder and allow the material to roll up a preselected height into the container to form the bottom profile of the container.

19 Claims, 13 Drawing Sheets

PRESS FOR FORMING CONTAINERS WITH PROFILED BOTTOMS

FIELD OF THE INVENTION

In general, the present application relates to the art of forming containers and more particularly relates to a press for forming containers with profiled bottoms.

BACKGROUND OF THE INVENTION

In the container industry, in general, and in the food container industry, in particular, it is desirable to produce containers having a bottom profile that imparts strength to the container. Typically, these profiles include one or more annular rings or recesses formed in the bottom of the container to improve the buckling strength of the container.

Early presses formed such profiles by preforming the profile in a first station by pressing the material against a die having a profile pad that defines the desired profile. After preforming, the container was then moved to a second station either in the same press or a separate press, where the container is hit again to "reform" or deepen the profile to its final depth. By transferring the container from the first station to the second station, tension within the side walls created during the reform operation is relieved. In other words, during the reforming or resetting of the bottom profile, it is desirable to minimize the distance that the metal has to be pulled from the side wall to finally form the bottom profile. In this way, the severe stresses in forming a final profile in one stoke are relieved avoiding damage to the container that would cause it to be scrapped. While the two station method is effective in minimzing the stresses of forming a profile, based on this method's disadvantages of having to handle the container two times and the additional time needed to transfer the container between stations, presses have been developed to perform the preform and reform steps in a single press.

In one example in the industry, the press includes a punch assembly and die assembly located axially opposite of each other, where the punch assembly descends to first blank the material and then wipe the material over the outer perimeter of the die assembly to form an inverted container. As the inverted container is completed, the core of the punch contacts the core of the die to impart an initial profile to the bottom of the container. The core of the punch continues downward drawing the container inside out to form an upright container. At the bottom of the punch core's stroke, both the punch core and die core bottom out causing the punch core to press the material into a profile pad carried on the die assembly to impart the finished profile to the bottom of the container.

A pressure cylinder is formed beneath the profile pad such that the descending blow of the punch builds pressure behind the pressure pad causing it to fire upward as the punch assembly is withdrawn. It has been discovered that the pressure created behind the profile pad causes it to overtake the punch as it is withdrawn causing the profile to be too deep. As will be appreciated, given the small thicknesses involved, such deepening can significantly weaken the container. In some cases, this may lead to the bottom of the container being torn out during subsequent processing or in use. Consequently, a need exists in the art for a press for forming a container with a bottom profile that selectively controls movement of the profile pad up and down through movement of a die core riser up and down for the profile pad to selectively form the bottom profile in the container in cooperation with the punch.

It has also been found that in operating prior presses for forming containers with profiled bottoms, the tooling, and, particularly, the profile pad or the profile pad and the punch and the redraw die or the redraw die and the pressure sleeve, expand, as the press heats up. This expansion causes the tolerances between the punch and the profile pad, the pressure sleeve and the redraw die to fall outside of specification, which often results in variations in the height of the bottom profile and the height of the sidewall of the container. One variation that can occur is a deepening of the bottom profile and the sidewall. As will be appreciated, such a deepening can result in a weakened container that must be scrapped. Consequently, a need exists in the art for a press for forming a container with a bottom profile that has one or more biasing members that accommodate expansion in certain tooling components during operation of the press.

It has also been found that operators of presses for forming containers with profiled bottoms had to remove tooling components from a bottom surface of a fixed base of the press. As can be appreciated, a mechanic had to climb under the press in order to remove certain tooling components in an inefficient, potentially hazardous and time consuming process. Consequently, a need exists in the art for a press for forming a container with a bottom profile that allows for the simplified removal of a tool pack of tool components located within a part of the fixed base wherein the tool pack is removable from a top surface of the base.

It has also been found that in operating prior presses for forming containers with profiled bottoms, the tooling, and, particularly, the punch and the profile pad can impart a deepened profile in the container. As will be appreciated, such deepening can result in a weakened container that must be scrapped. Consequently, a need exists in the art for a press for forming a container with a bottom profile that has a punch and a profile pad with an annular projection or an annular shoulder wherein the projection and the shoulder clamp material between the projection and the shoulder and allow the material to roll up a preselected height into the container to form the bottom profile of the container.

SUMMARY OF THE INVENTION

It is an object of the invention to provide a press for forming a container with a bottom profile that selectively controls movement of a profile pad up and down for the profile pad to selectively form the bottom profile in the container in cooperation with a punch.

It is another object of the invention to provide a press for forming a container with a bottom profile having a preselected height and a sidewall having a preselected height that accommodates expansion in the profile pad or in the profile pad and the punch and in the redraw die or in the redraw die and the pressure sleeve during operation of the press in order to control the height of the bottom profile and the height of the sidewall of the container.

It is another object of the invention to provide a press for forming a container with a bottom profile that has a tool pack of tool components located within a part of the fixed base wherein the tool pack is removable from the top surface of the base.

It is another object of the invention to provide a press for forming a container with a bottom profile that has a punch and a profile pad with a preselected flattened annular projection or a preselected flattened annular shoulder wherein the projection and the shoulder are structured to clamp material between the projection and the shoulder and allow the material to roll up a preselected height into the container in a controlled manner to form the bottom profile of the container.

An object of the invention is obtained by providing a press for forming a container with a bottom profile having a preselected height and a sidewall having a preselected height from a supply of material entering the press at a forming station. The press has a punch with a preselected profile secured to the press which is selectively actuated up and down by movement of the press. The press also has a pressure sleeve concentrically slidably disposed around the punch with a blank and draw punch secured to the press which is concentrically disposed around the pressure sleeve. The blank and draw punch can be selectively actuated up and down by movement of the press. The press additionally has a fixed base having a top surface and a bottom surface. The press also has a die core riser supported within the fixed base which is axially movable within the base with a profile pad with a preselected profile secured to an end of the die core riser with the profile pad being structured to be disposed within the fixed base in opposed relationship to the punch. The press additionally has a redraw die concentrically disposed around a portion of the punch in opposed relationship to the pressure sleeve with a draw pad concentrically slidably disposed around the redraw die in opposed relationship to the blank and draw punch. The press also has a cut edge located adjacent to the draw pad. The press additionally has a piston operatively connected to the die core riser with a cylinder disposed below the base which houses the piston. The cylinder has a first passage communicating with the cylinder above the piston and a second passage communicating with the cylinder below the piston with the passages being connected to a fluid or gas supply to selectively pressurize the cylinder on at least one side of the piston, whereby the passages selectively control movement of the profile pad up and down through movement of the die core riser up and down for the profile pad to selectively form the bottom profile in the container in cooperation with the punch. In operation, the blank and draw punch is structured to blank the material against the cut edge and draw the material into an inverted container by wiping the material over the redraw die during descent of the blank and draw punch while the pressure sleeve and redraw die hold the material between the pressure sleeve and the redraw die. Next, the punch is structured to redraw the inverted container into a container by pulling the inverted container over the redraw die during descent of the punch. Finally, the profiled punch and the profile pad are structured to cooperate with each other to form the bottom profile of the container.

Another object of the invention is obtained by providing a press for forming a container with a bottom profile having a preselected height and a sidewall having a preselected height from a supply of material entering the press at a forming station. The press has a punch with a preselected profile secured to the press which is selectively actuated up and down by movement of the press. The press also has a pressure sleeve concentrically slidably disposed around the punch with a blank and draw punch secured to the press which is concentrically disposed around the pressure sleeve. The blank and draw punch can be selectively actuated up and down by movement of the press. The press additionally has a fixed base having a top surface and a bottom surface. The press also has a profile pad with a preselected profile structured to be disposed within the fixed base in opposed relationship to the punch with a redraw die concentrically disposed around a portion of the punch in opposed relationship to the pressure sleeve. The press additionally has a draw pad concentrically slidably disposed around the redraw die in opposed relationship to the blank and draw punch with a cut edge located adjacent to the draw pad. In operation, the blank and draw punch is structured to blank the material against the cut edge and draw the material into an inverted container by wiping the material over the redraw die during descent of the blank and draw punch while the pressure sleeve and redraw die hold the material between the pressure sleeve and the redraw die. Next, the punch is structured to redraw the inverted container into a container by pulling the inverted container over the redraw die during descent of the punch. Finally, the profiled punch and the profile pad are structured to cooperate with each other to form the bottom profile of the container.

Another object of the invention is obtained by providing the presses described above with a biasing member located in the base structured to accommodate expansion in the profile pad or in the profile pad and the punch and in the redraw die or in the redraw die and the pressure sleeve during operation of the press. The biasing member located in the base is compressed as the profile pad or the profile pad and the punch and the redraw die or the redraw die and the pressure sleeve expand due to heat generated by the press during operation of the press in order to control the height of the bottom profile and the height of the sidewall of the container.

Another object of the invention is obtained by providing the presses described above with a first biasing member located in the base structured to accommodate expansion in the profile pad or in the profile pad and the punch during operation of the press and a second biasing member located in the base structured to accommodate expansion of the redraw die or in the redraw die and the pressure sleeve during operation of the press. The first biasing member located in the base is compressed as the profile pad or the profile pad and the punch expand due to heat generated by the press during operation of the press in order to control the height of the bottom profile. The second biasing member located in the base is compressed as the redraw die or the redraw die and the pressure sleeve expand due to heat generated by the press during operation of the press in order to control the height of the sidewall of the container.

Another object of the invention is obtained by providing the presses described above with a tool pack of tool components located within a part of the fixed base wherein the tool pack is removable from the top surface of the base.

Another object of the invention is obtained by providing the presses described above with the respective punch and the profile pad having a preselected flattened annular projection or a preselected flattened annular shoulder. The projection and the shoulder are structured to clamp the material between the projection and the shoulder and allow the material to roll up a preselected height into the container in a controlled manner to form the bottom profile of the container.

DETAILED DESCRIPTION OF PREFERRED EMBODIMENTS

Figure 1:
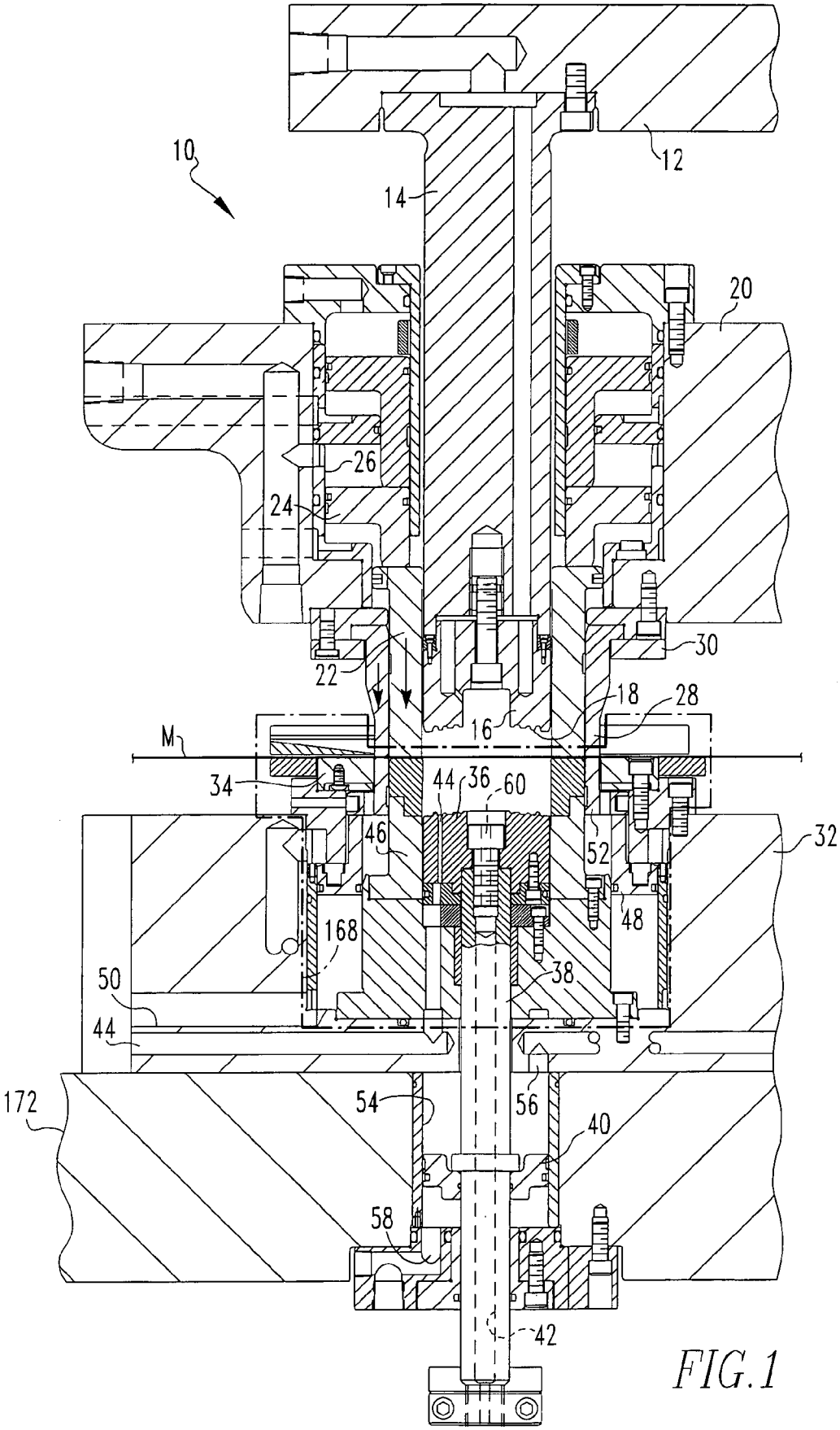
FIG. 1 is an elevational assembly view of an embodiment of a press showing the press blanking material.

Referring to FIG. 1, a press 10 according to an embodiment of the present invention shown. Press 10 generally has an inner slide and an outer slide to which tooling is attached. The slides reciprocate relative to a fixed base that is capable of independent control and may carry further tooling, as described more completely below. The slides may move relative to each other and are controlled as to phase angle and shut height.

Figure 4:
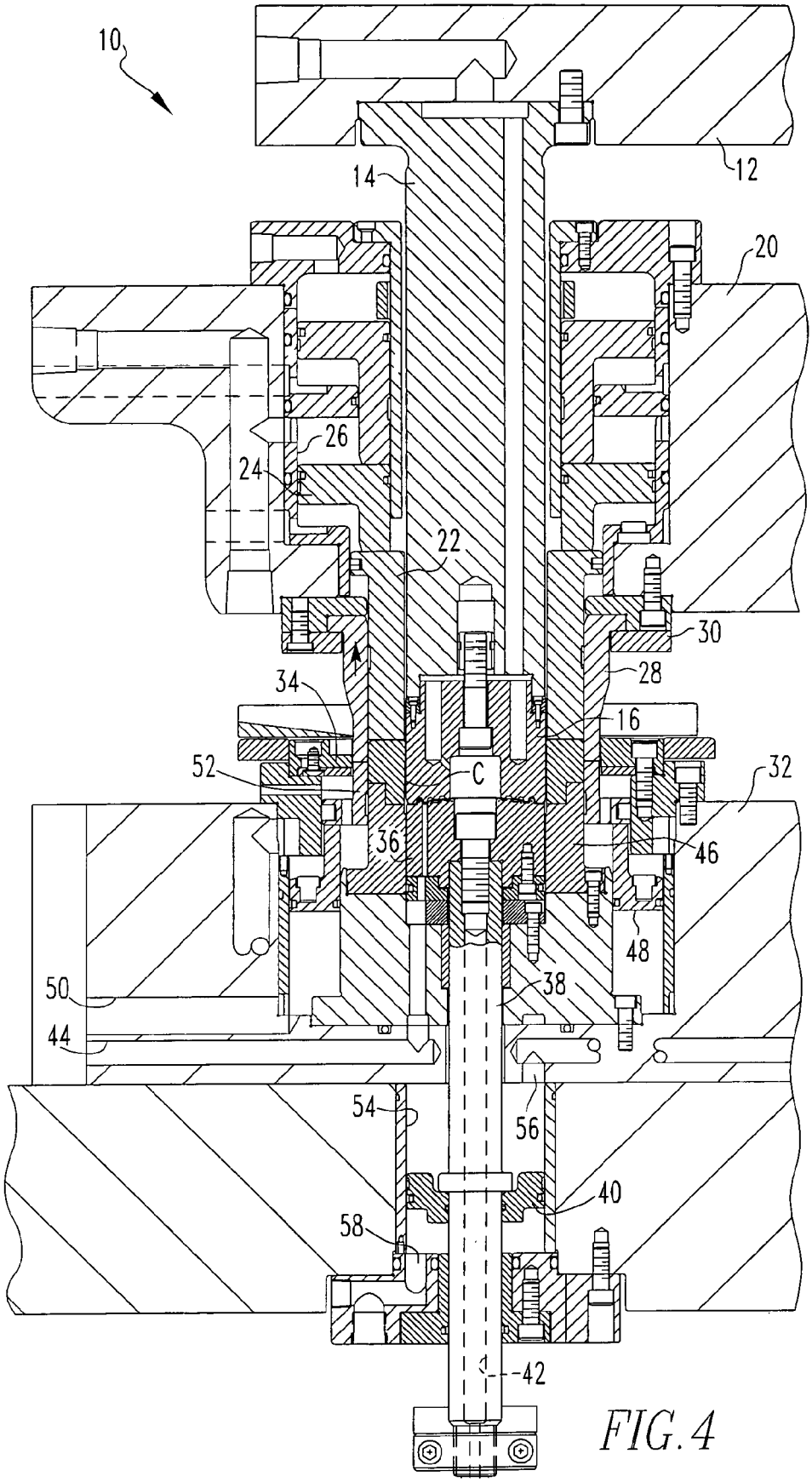
FIG. 4 is an elevational assembly view of an embodiment of a press showing the press after the reverse drawing and a preliminary bottom profiling of the container.
Figure 5:
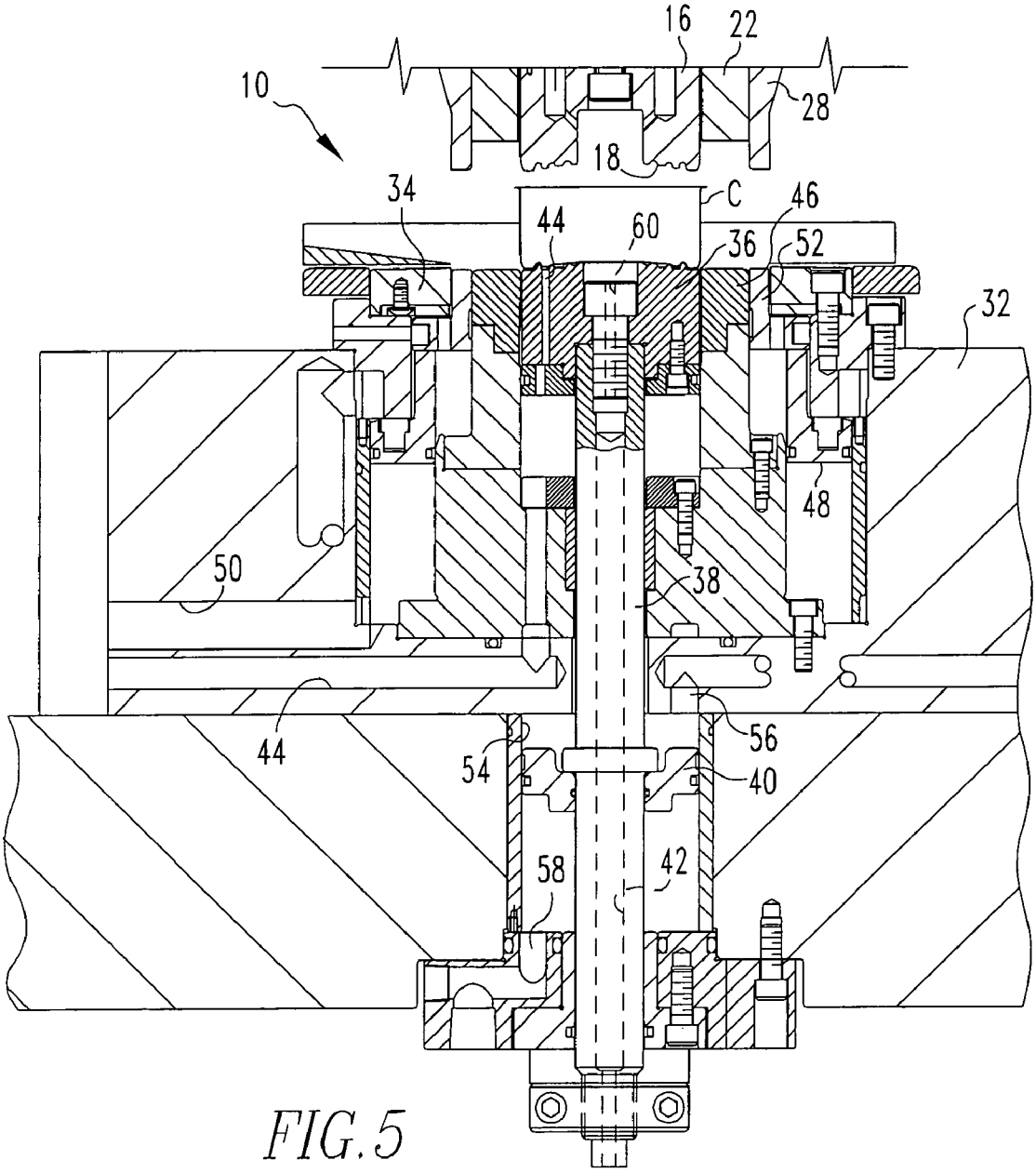
FIG. 5 is an elevational assembly view of an embodiment of a press showing the press after the bottom profiled container has been formed.

With continued reference to FIG. 1, the position of the tooling is shown just prior to blanking of material M within the press 10, while the position of the tooling depicted in FIG. 5 is after formation of a bottom profiled container. The remaining FIGS. 1-5 illustrated the position of the tooling at various stages during the forming process and will be described more completely below.

Referring to FIG. 1, the press 10 generally includes an inner slide holder 12 that is secured to a riser 14, as by screws. The projecting end of the riser 14 carries a punch 16 secured thereto by a screw and which has a profiled bottom surface 18. The punch 16 has a preselected profile and is selectively actuated up and down by movement of the inner slide holder 12.

The outer rim of the press 10 carries an outer slide holder 20, which is arranged generally in concentric relationship with respect to the riser 14 carried by the inner slide holder 12. Surrounding a portion of the riser 14 is a pressure sleeve 22, which is slidably disposed within the outer slide holder 20 and which is disposed beneath an upper piston 24, which is also slidable under fluid or gas pressure through a bore 26 so that pressure acting on the piston 24 will also act on the pressure sleeve 22, as described more completely below. The pressure sleeve 22 is concentrically disposed around the punch 16. The outer slide holder 20 may also carry a blank and draw punch 28 and retainer 30, which may be secured by screws. The blank and draw punch 28 is concentrically disposed around the pressure sleeve 22 with the blank and draw punch 28 being selectively actuated up and down with movement of the outer slide holder 20.

Disposed in opposed relationship to the inner and outer slide holders 12 and 20 of the press 10 is the fixed base 32, which also carries a number of tooling components. The fixed base 32 has a top surface and a bottom surface. For example, a cut edge 34 may be secured to the base 32, as by screws, and cooperates with the blank and draw punch 28 for blanking the material M. Inboard of the cut edge 34 is a profile pad 36 which has a preselected profile located centrally within a die cavity in the fixed base 32. The profile pad 36 is secured to a die core riser 38, which is axially movable up and down by actuating piston 40 operatively connected to the die core riser 38 which selectively moves the profile pad 36 up and down with respect to the fixed base 32. Profile pad 36 is structured to be disposed within the fixed base 32 in opposed relationship to the punch 16. Profile pad 36 also has through vent passages 42, 44 that permit venting to the atmosphere for purposes described more completely below.

Also arranged concentrically around a portion of the profile pad 36 is a redraw die 46. The redraw die 46 sits in opposed relationship to the pressure sleeve 22. Concentrically arranged around the redraw die 46 and located beneath the cut edge 34 is a lower piston 48 that is actuated by a source of high pressure fluid or gas through a bore 50. Supported on top of this lower piston 48 is a draw pad 52 concentrically disposed around the redraw die 46 that cooperates with the blank and draw punch 28, as described more completely below. Draw pad 52 sits in opposed relationship to the blank and draw punch 28.

Figure 2:
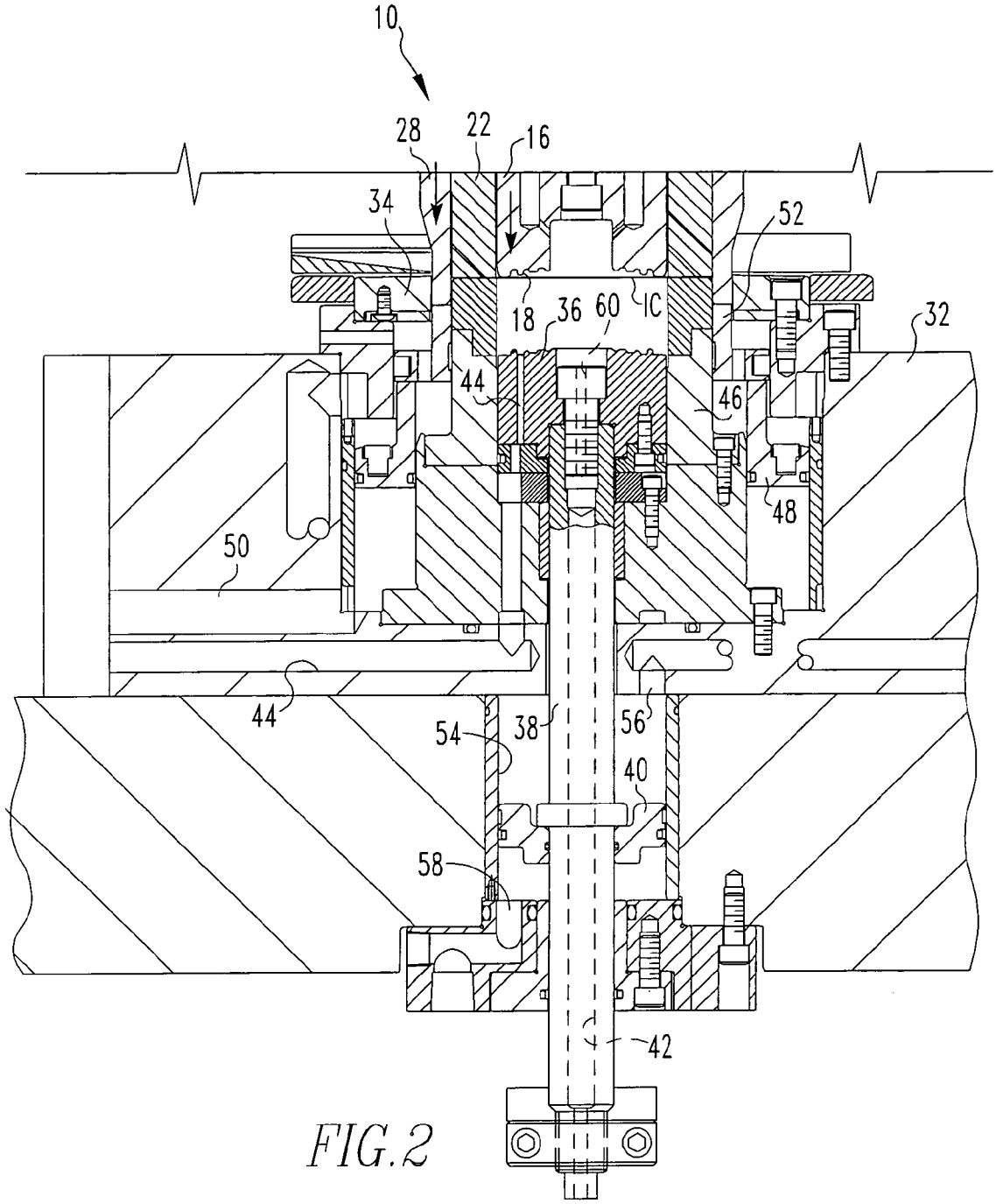
FIG. 2 is an elevational assembly view of an embodiment of a press showing the press following blanking of the material and forming an inverted container.

As shown in FIG. 2, the piston 40 is operatively connected to the die core riser 38 and may be located away from the tooling of the press, for example, housed in a cylinder 54 formed below the base 32 and axially spaced from profile pad 36. Cylinder 54 is sized to allow axial movement of the piston 40 up and down and accordingly the die core riser 38, as will be described more completely below. First passage 56 and second passage 58 communicate with the cylinder 54 on opposite sides of the piston 40, such that fluid or gas may be fed into the cylinder 54 on a selected side of the piston 40 to selectively control movement of the die core riser 38 up and down. For example, fluid or gas such as air, may enter through passage 56 pressurizing the cylinder 54 above the piston 40 to urge the piston 40 and accordingly the profile pad 36 and die core riser 38 downward. Likewise, fluid or gas such as air, delivered through passage 58 may pressurize the cylinder 54 below the piston 40 to urge the piston 40 and accordingly the profile pad 36 and die core riser 38 upward. In this way, the movement of the profile pad 36, which is secured to the die core riser 38 may be selectively controlled to prevent improper formation of the profile within the container C, during the operation of the press 10, as will be described more completely below. Suitable valves, such as check valves (not shown) may be associated with the passages 56, 58 to control pressurization of the cylinder 54 on either side of the piston 40. The valves also may be used to close passages 56, 58 to maintain a selected pressure within cylinder 54. For example, passage 58 may be closed, such that profile pad 36 is maintained at a bottom dead center position, such that the profile is formed at this point.

Referring to FIGS. 1-5, operation of the press 10 will now be described. Material M may be fed into the opening of the press 10 in the form of either sheet or coil stock and is in the position of FIG. 1 just prior to blanking. The profile pad 36 is retracted from the tin line (the plane defined by the material M, as it is initially fed into the press) by applying pressure to the top of piston 40 through passage 56, avoiding premature profiling of the container C. The profile pad 36 is then held by the pressure within cylinder 54.

At this time, the inner and outer slide holders 12 and 20 descend toward the base 32. Soon thereafter, blank and draw punch 28 contacts the material M, as has the pressure sleeve 22, under the force of piston 24. The blank and draw punch 28 and the pressure sleeve 22 cooperate with the draw pad 52 and the redraw die 46 to begin forming an inverted container IC from the material M. At this point, the lower piston 48 is in an elevated position, such that the draw pad 52 supports the material M beneath the blank and draw punch 28. The fixed redraw die 46 is also in a supporting relationship with the material M.

Further downward movement of the slide holders 12 and 20 moves the tooling from the position depicted in FIG. 1 to that of FIG. 2 to first blank the material M and form an inverted container IC, as will be described below. To perform blanking, the blank and draw punch 28 severs the material M against the cut edge 34 during its descent. Then, continued downward movement of the blank and draw punch 28 wipes the periphery of the blank of material M about the top of the redraw die 46 to form an inverted container IC while the pressure sleeve 22 and the redraw die 46 hold the material M between pressure sleeve 22 and the redraw die 46, as shown in FIG. 2. At this point, the profile pad 36 is located below the center of the inverted container IC and is supported just beneath the central part of the inverted container IC by fluid or gas pressure from piston 40. Any air trapped beneath the material M is exhausted through vent passage 60.

Figure 3:
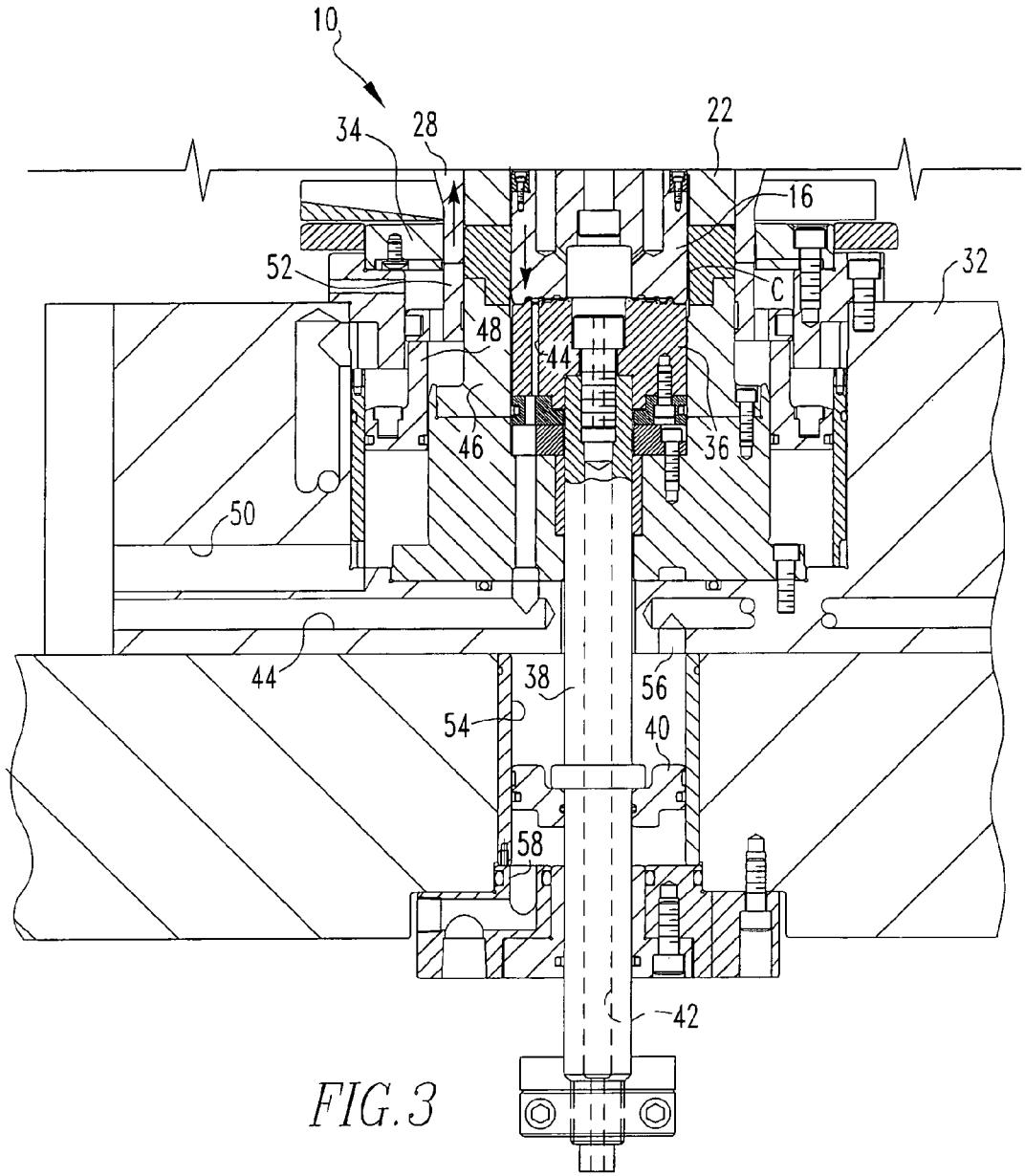
FIG. 3 is an elevational assembly view of an embodiment of a press showing the press reverse drawing the inverted container and forming a container.

Continued downward movement of the slides 12 and 20 moves the tooling from the position of FIG. 2 to the position of FIG. 3 to initiate redraw and inversion of the inverted container IC. At this point, the pressure on profile pad 36 exerted by piston 40 is such that no profiling will initially take place. The high points on the bottom of the punch 16 and top of profile pad 36 contact the material M and the punch 16 will force the profile pad 36 down to continue the reverse draw of the inverted container IC to form container C. The movement of the inner slide pulls the material M over the top of the redraw die 46 to effectively turn the previously formed inverted container IC inside out to form container C. During the reverse draw, downward movement of the punch 16 eventually causes the piston 40 to reach a point where the pressure below piston 40 is sufficient to cause the bottom to be initially profiled by the profile pad 36. Continued movement of the slide 12 toward the fixed base 32 forces the riser 38 and the punch 16 downward against the material M in the bottom of the container C to impart the desired contour to the bottom, as shown in FIG. 3. It will be appreciated that this profile is dictated by the complementary configuration of the punch 16 and profile pad 36.

When using a knockout ring (not shown), the downward movement of punch 16 compresses the spring loaded or air supported knockout ring. Movement of slide 20 causes the blank and draw punch 28 to force the draw pad 52 and piston 48 downward overcoming the fluid or gas pressure beneath piston 48. At this point, a container C has been formed and a preliminary bottom profile has been imparted to the container C.

Comparing the positions depicted in FIGS. 3 and 4, it will be noted that between these positions, the outer slide holder 20 reaches bottom dead center and begins to retract. The blank and draw punch 28 begins to pull away from the fixed base 32, while the inner slide 12 continues downward movement against the fluid or gas pressure on piston 40. This movement increases resistance completing the reverse draw of the container C without disturbing the bottom profile established at FIG. 3.

As the inner slide 12 begins to pull away from the base 32, the profile will be finally set. To prevent the profile pad 36 from deepening the bottom profile beyond its desired depth on the up stroke of the press 10, pressure may be applied to piston 40 by fluid or gas delivered through passages 56, 58 to selectively control the upward movement of the die core riser 38. In this way, the profile pad 36 is prevented from overtaking the punch 16, as is common in the prior art.

For example, after the container C has been formed in the redraw process, the punch tooling begins to move upward and the container C is raised to the tin line. At this point, the punch is still partially within the container C and the profile pad 36 is held by the fluid or gas pressure within cylinder 54. Eventually, the punch clears the container C. With the punch cleared, the profile pad 36 may be raised without the risk of deepening the profile formed in the container C. To raise the die core riser 38, fluid or gas pressure may be applied below piston 40. After the container C is ejected, the profile pad 36 may be urged downward from the tin line to a selected position to begin a subsequent forming cycle.

It has found that in operating the press 10, the tooling, and, particularly, the profile pad 36 or the profile pad 36 and the punch 16 and the redraw die 46 or the redraw die 46 and the pressure sleeve 22 and the redraw die 46, expands, as the press 10 heats up. This expansion causes the tolerances between the punch 16 and the profile pad 36, the pressure sleeve 22 and the redraw die 46 to fall outside of specification, which often results in variations in the height of the bottom profile and the height of the sidewall of the container C. One variation that can occur is a deepening of the bottom profile and the sidewall. As will be appreciated, such a deepening can result in a weakened container C that must be scrapped.

Figure 6:
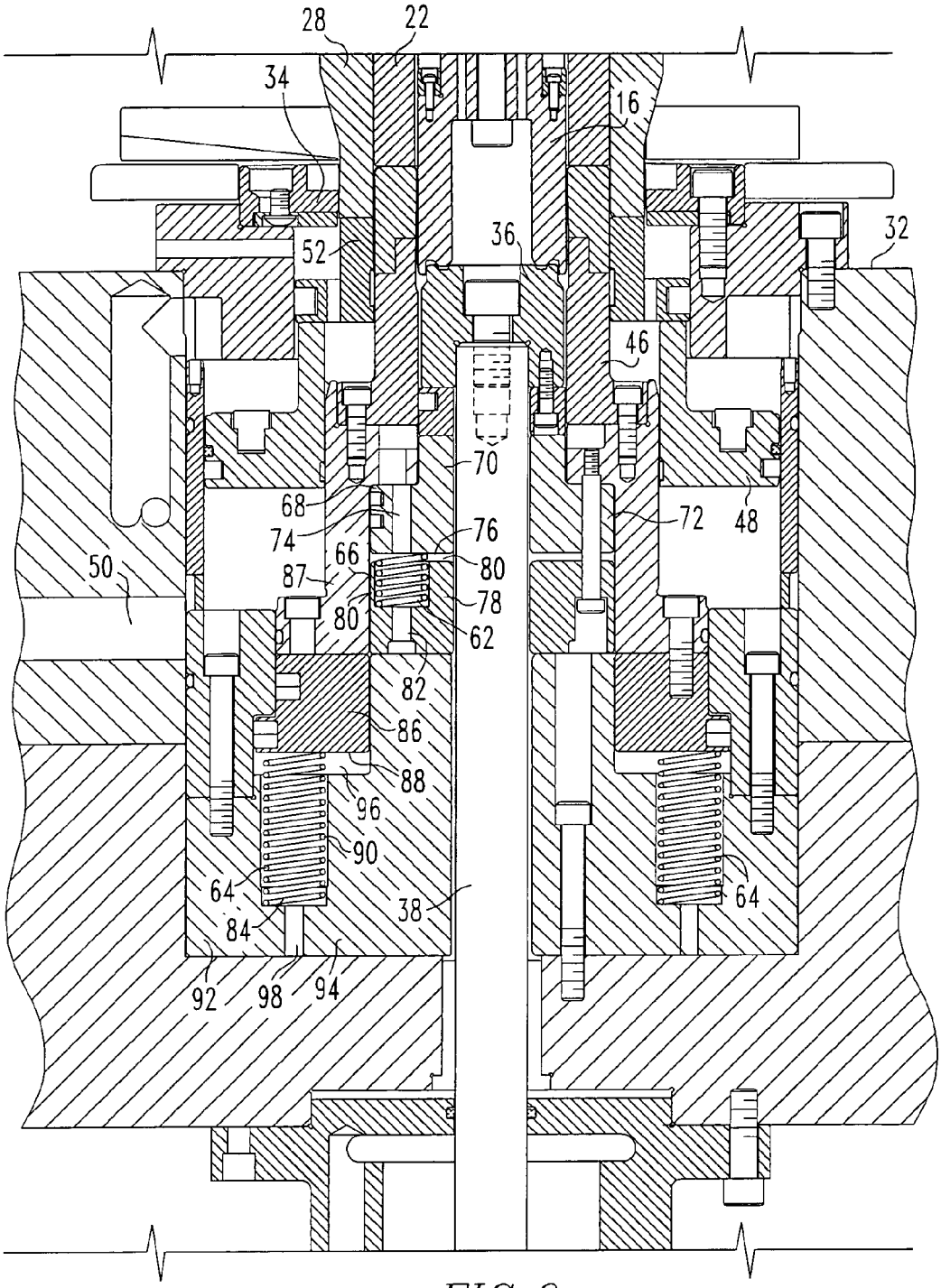
FIG. 6 is an elevational view of an embodiment of a press showing biasing members that accommodate thermal growth between a punch and a profile pad and a pressure sleeve and a redraw die.

In view of this fact, press 10 may optionally include a first expansion assembly 62 and a second expansion assembly 64 as shown in FIG. 6. In general, expansion assembly 62 includes a first biasing member 66 that compresses to the extent necessary to offset any thermal expansion of the profile pad 36 or the punch 16 and the profile pad 36 due to heat generated by the press 10 during operation of the press 10 in order to control the height of the bottom profile of the container. While biasing member 66 is depicted in FIG. 6 as a spring, one of ordinary skill in the art would recognize that biasing member 66 could be an elastomeric component or any other component that can be compressed. Biasing member 66 may supportingly contact the profile pad 36. While the biasing member 66 may directly engage the profile pad 36, a biasing member pad 68 may be used to allow for a more convenient placement of the biasing member 66 out of the way of the moving components. In the example shown, biasing member pad 68 has a generally cylindrical shape with a nose portion 70 disposed below the profile pad 36 at its upper axial extremity and a radial outward extending flange 72 at its lower axially extremity filling the bore defined beneath the profile pad 36 and the redraw die 46. A through bore 74 may be formed in flange 72 for venting purposes. The lower surface 76 of the biasing member pad 68 rests on the biasing member 66. In the example shown, a biasing member holder, generally indicated by the numeral 78 rests on the fixed base 32 and defines a recess 80 for receiving at least a portion of the biasing member 66. Biasing member 66 extends axially upward from the biasing member holder 78 to define a clearance 80 therebetween. It will be appreciated that the biasing member holder 78 may be omitted. Like biasing member pad 68, biasing member holder 78 may define one or more vents 82 that extend through the biasing member holder 78 for venting purposes.

Likewise, second expansion assembly 64 includes a second biasing member 84 that compresses to the extent necessary to offset any thermal expansion of the redraw die 46 or the pressure sleeve 22 and the redraw die 46 due to heat generated by the press 10 during operation of the press 10 in order to control the height of the sidewall of the container. While biasing member 84 is depicted in FIG. 6 as a spring, one of ordinary skill in the art would recognize that biasing member 84 could be an elastomeric component or any other component that can be compressed. Biasing member 84 may supportingly contact the redraw die 46. While the biasing member 84 may directly engage the redraw die 46, a biasing member pad 86 may be used to allow for a more convenient placement of the biasing member 84 out of the way of the moving components. In the example shown, biasing member pad 86 has a generally cylindrical shape which contacts a cylindrical spacer 87 secured to the redraw die 46. The lower surface 88 of the biasing member pad 86 rests on the biasing member 84. In the example shown, a portion of the biasing member 84 is disposed in a recess 90 that is defined between press components 92 and 94 which rest under the fixed base 32. Biasing member 84 extends axially upward from the recess 90 to define a clearance 96 therebetween. One or more vents 98 may be provided beneath the biasing member 84 for venting purposes.

As operation of the press 10 continues and the tooling heats up, in response to the greater extension of the profile pad 36 or the punch 16 and the profile pad 36, the profile pad 36 compresses biasing member 66 to the extent that the punch 16 and the profile pad 36 exceeds its ordinary tolerance. In this way, the tolerance between the punch 16 and the profile pad 36 is maintained avoiding any defect in the bottom profile of the container C.

Likewise, as operation of the press 10 continues and the tooling heats up, in response to the greater extension of the redraw die 46 or the pressure sleeve 22 and the redraw die 46, the redraw die 46 compresses biasing member 84 to the extent that the pressure sleeve 22 and the redraw die 46 exceeds its ordinary tolerance. In this way, the tolerance between the pressure sleeve 22 and the redraw die 46 is maintained avoiding any defect in the sidewall of the container C. While expansion assemblies 62 and 64 are shown in use with a press 10 that has a profile pad 36 that is secured to a movable die core riser 38, one of ordinary skill in the art would recognize that expansion assemblies 62 and 64 could be used in a press 110 that employs the use of a profile pad 136 that is secured to a fixed base 132 of the type shown in FIGS. 9-13 of this patent application.

Figure 7:
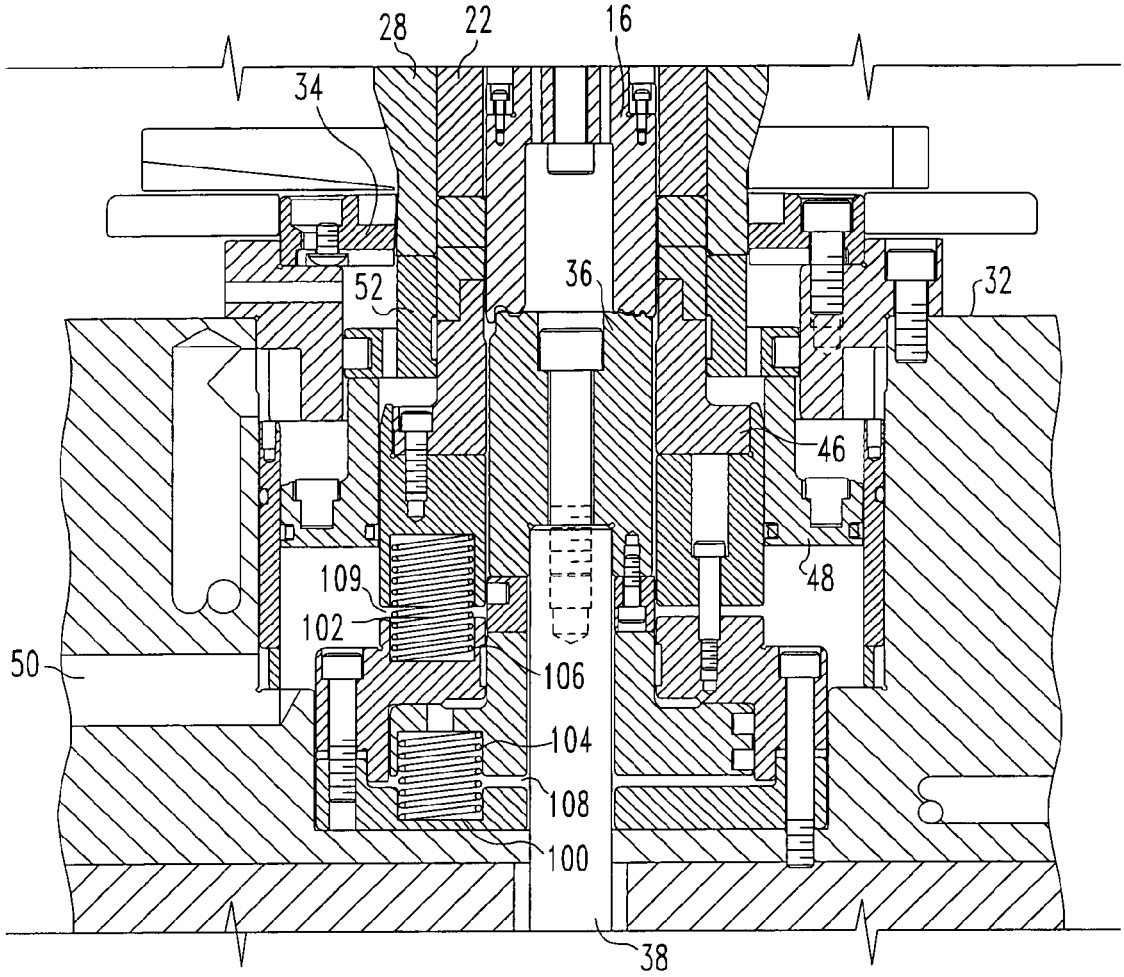
FIG. 7 is an elevational view of an embodiment of a press showing biasing members that accommodate thermal growth between a punch and a profile pad and a pressure sleeve and a redraw die.

FIG. 7 depicts another embodiment of a press 10 that has a profile pad 36 that is secured to a movable die core riser 38 with an alternative arrangement of a first expansion assembly 100 and a second expansion assembly 102 that respectively contain a first biasing member 104 and a second biasing member 106. The biasing members 104, 106 function in a similar manner to the biasing members 66, 84. In general, expansion assembly 100 includes a biasing member 104 that compresses to the extent necessary to offset any thermal expansion of the profile pad 36 or the punch 16 and the profile pad 36 due to heat generated by the press 10 during operation of the press 10 in order to control the height of the bottom profile of the container. While biasing member 104 is depicted in FIG. 7 as a spring, one of ordinary skill in the art would recognize that biasing member 104 could be an elastomeric component or any other component that can be compressed. Biasing member 104 may supportingly contact the profile pad 36. While the biasing member 104 may directly engage the profile pad 36, the biasing member 104 may be situated below the profile pad 36, the redraw die 46 and/or the draw pad 52 for a more convenient placement of the biasing member 104 out of the way of the moving components. One or more vents may be provided adjacent to the biasing member 104 for venting purposes. Biasing member 104 extends axially upwardly and provides a clearance 108 between various press components.

Likewise, expansion assembly 102 includes a biasing member 106 that compresses to the extent necessary to offset any thermal expansion of the redraw die 46 or the pressure sleeve 22 and the redraw die 46 due to heat generated by the press 10 during operation of the press 10 in order to control the height of the bottom profile of the container C. While biasing member 106 is depicted in FIG. 7 as a spring, one of ordinary skill in the art would recognize that biasing member 106 could be an elastomeric component or any other component that can be compressed. Biasing member 106 may supportingly contact the redraw die 46. While the biasing member 106 may directly engage the redraw die 46, the biasing member 106 may be situated below the profile pad 36, the redraw die 46 and/or the draw pad 52 for a more convenient placement of the biasing member 106 out of the way of the moving components. One or more vents may be provided adjacent to the biasing member 106 for venting purposes. Biasing member 106 extends axially upwardly and provides a clearance 109 between various press components.

As operation of the press 10 continues and the tooling heats up, in response to the greater extension of the profile pad 36 or the punch 16 and the profile pad 36, the profile pad 36 compresses biasing member 104 to the extent that the punch 16 and the profile pad 36 exceeds its ordinary tolerance. In this way, the tolerance between the punch 16 and the profile pad 36 is maintained avoiding any defect in the profile of the container C.

Likewise, as operation of the press 10 continues and the tooling heats up, in response to the greater extension of the redraw die 46 or the pressure sleeve 22 and the redraw die 46, the redraw die 46 compresses biasing member 106 to the extent that the pressure sleeve 22 and the redraw die 46 exceeds its ordinary tolerance. In this way, the tolerance between the pressure sleeve 22 and the redraw die 46 is maintained avoiding any defect in the sidewall of the container C. While expansion assemblies 100, 102 are shown in use with a press 10 that has a profile pad 36 that is secured to a movable die core riser 38, one of ordinary skill in the art would recognize that expansion assemblies 100, 102 could be used in a press 110 that employs the use of a profile pad 136 that is secured to a fixed base 132 of the type shown in FIGS. 9-13 of this patent application.

Figure 8:
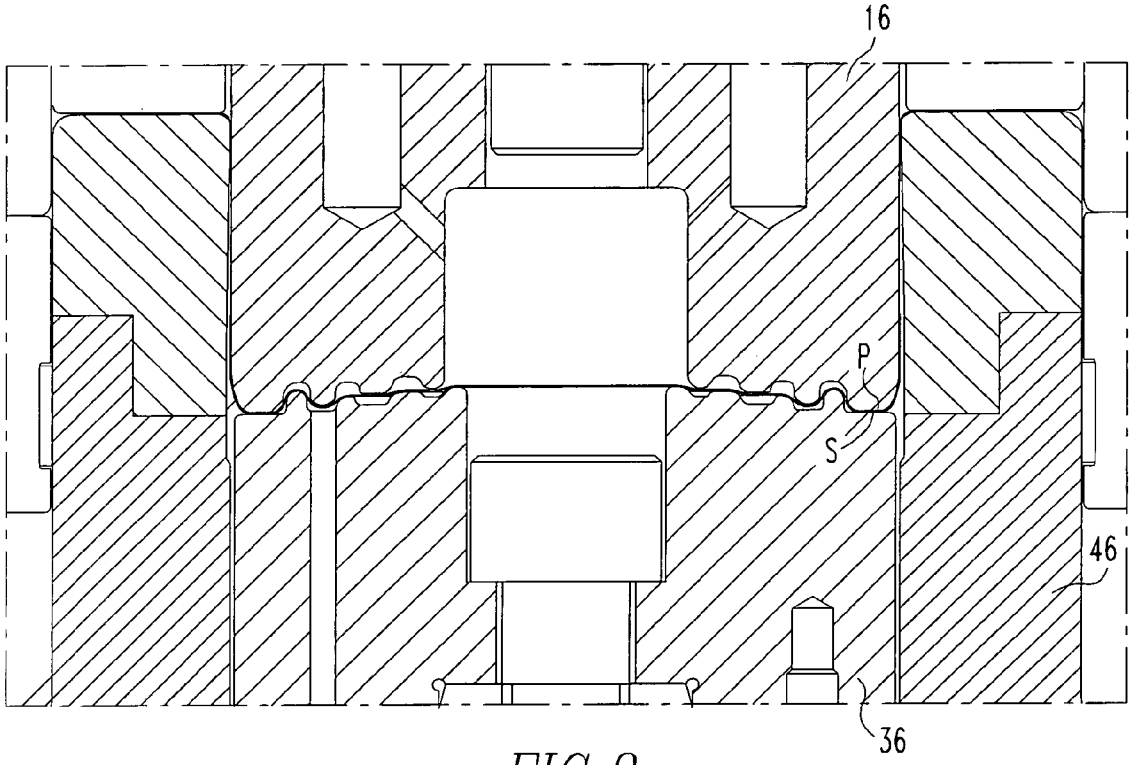
FIG. 8 is a cross sectional view of an embodiment of a press showing material clamped between a punch having a flattened annular projection and a profile pad having a flattened annular shoulder which rolls material up a preselected height into a container in a controlled manner to form the container with a profiled bottom.

It has found that in operating the press 10, the tooling, and, particularly, the punch 16 and the profile pad 36 can impart a deepened profile in the container C. As will be appreciated, such deepening can result in a weakened container C that must be scrapped. In view of this fact, press 10 may optionally use a punch 16 that includes a flattened annular projection P at its radially outward extremity and a profile pad 36 that includes a flattened annular shoulder S at its radially outward extremity wherein the material M is clamped between projection P and shoulder S, as shown in FIG. 8. By clamping the material M between the flattened annular projection P and the flattened annular shoulder S at this point, the material M is prevented from rolling up in an uncontrolled manner into the profiled base of the container C, which often causes irregularities in the profile of the container C. As a result, a more consistent and dimensionally accurate container C may be produced with the punch 16 and the profile pad 36 of FIG. 8 and the clamping of the flattened annular projection P with the flattened annular shoulder S allows the material M to roll up a preselected height into the container C in a controlled manner to form a container C with a profiled bottom. The punch 16 also employs the use of a plurality of annular recesses and a plurality of annular projections that correspond to a plurality of annular projections and a plurality of annular recesses disposed on the profile pad 36 which form the profile in the container C between the punch 16 and the profile pad 36. While the flattened annular projection P is shown at its radially outward extremity on the punch 16 and the flattened annular shoulder S is shown at its radially outward extremity on the profile pad 36, one of ordinary skill in the art would recognize that projection P and shoulder S could be located in the center of the punch 16 and the profile pad 36 or elsewhere on the punch 16 and the profile pad 36 so long as the material M is clamped between the flattenend annular projection P and the flattened annular shoulder S to allow the material M to roll up a preselected height into the container C in a controlled manner to form a container C with a profiled bottom. Likewise, flattened annular projection P could be located on the profile pad 36 or the flattened annular shoulder S could be located on the punch 16 so long as the material M is clamped between the flattenend annular projection P and the flattened annular shoulder S to allow the material M to roll up a preselected distance into the container C in a controlled manner to form a container C with a profiled bottom. The punch and profile pad of FIG. 8 may be used in a press 10 that has a profile pad 36 that is secured to a movable die core riser 38 of the type shown in FIGS. 1-7 of the present patent application or could be used in a press 110 that employs the use of a profile pad 136 that is secured to a fixed base 132 of the type shown in FIGS. 9-13 of this patent application.

Figure 9:
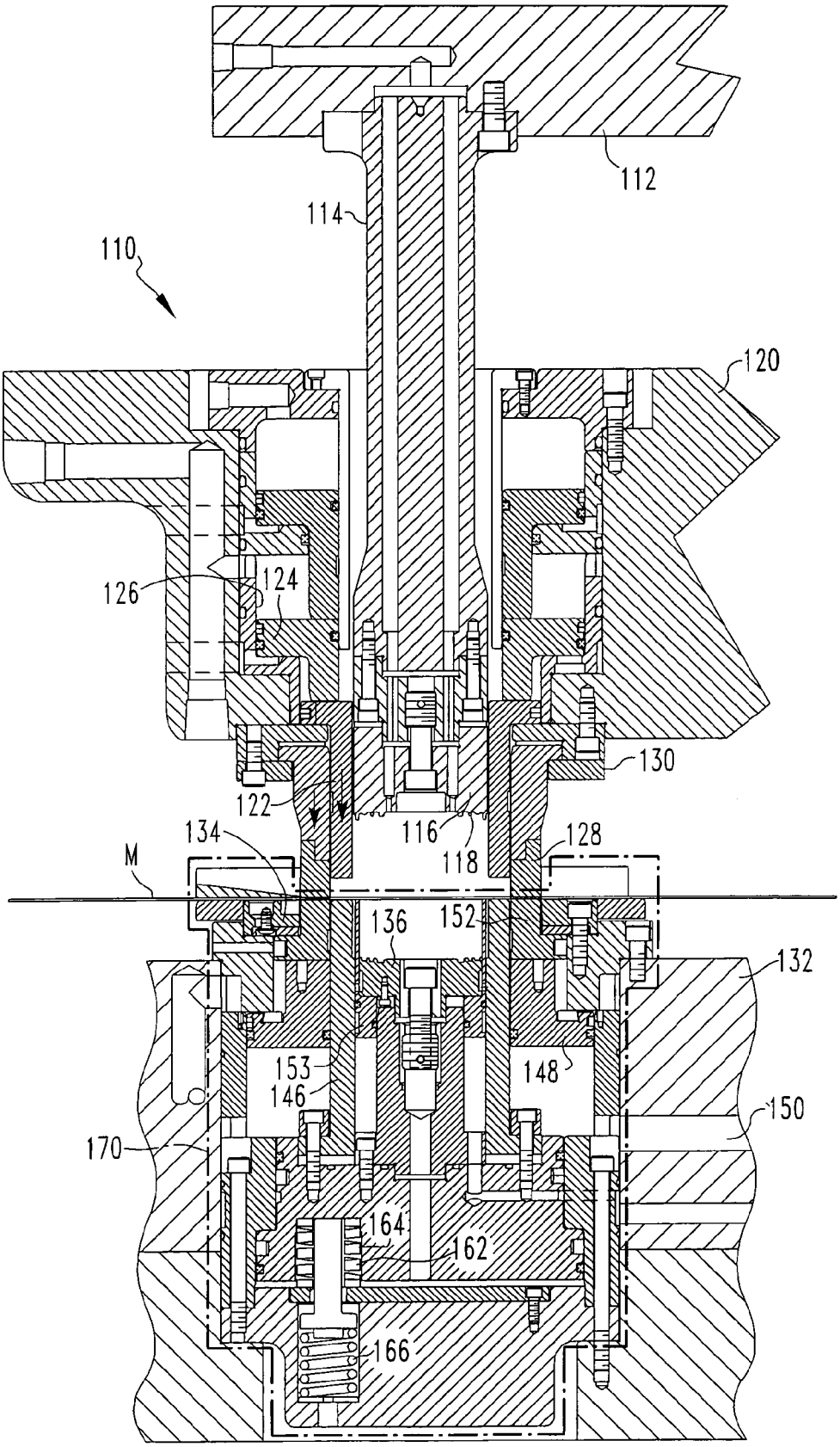
FIG. 9 is an elevational assembly view of an embodiment of a press showing the press blanking material.

Referring to FIG. 9, a press 110 according to an embodiment of the present invention is shown. Press 110 generally has an inner slide and an outer slide to which tooling is attached. The slides reciprocate relative to a fixed base that is capable of independent control and may carry further tooling, as described more completely below. The slides may move relative to each other and are controlled as to phase angle and shut height.

Figure 12:
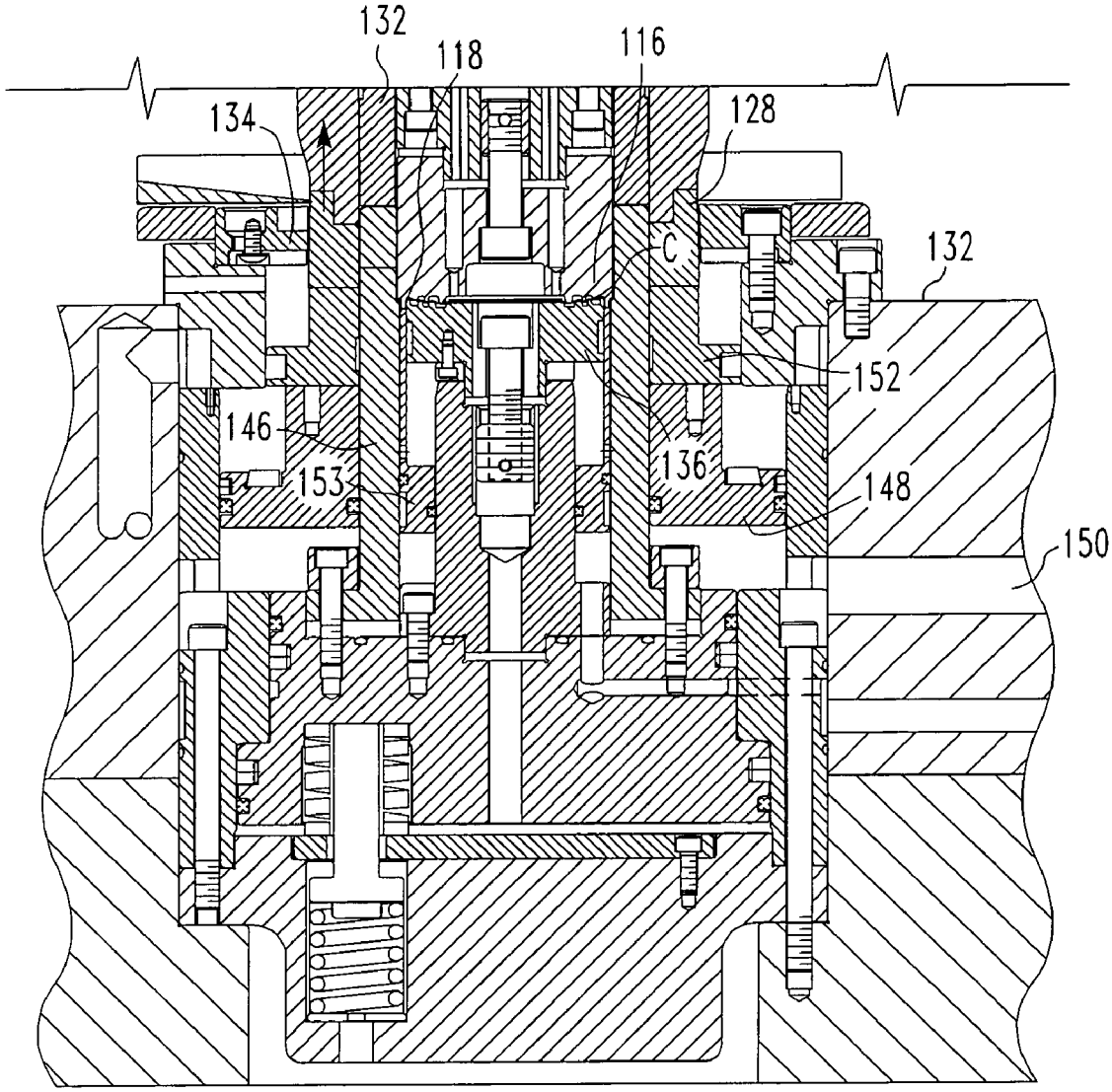
FIG. 12 is an elevational assembly view of an embodiment of a press showing the press after the reverse drawing and a preliminary bottom profiling of the container.
Figure 13:
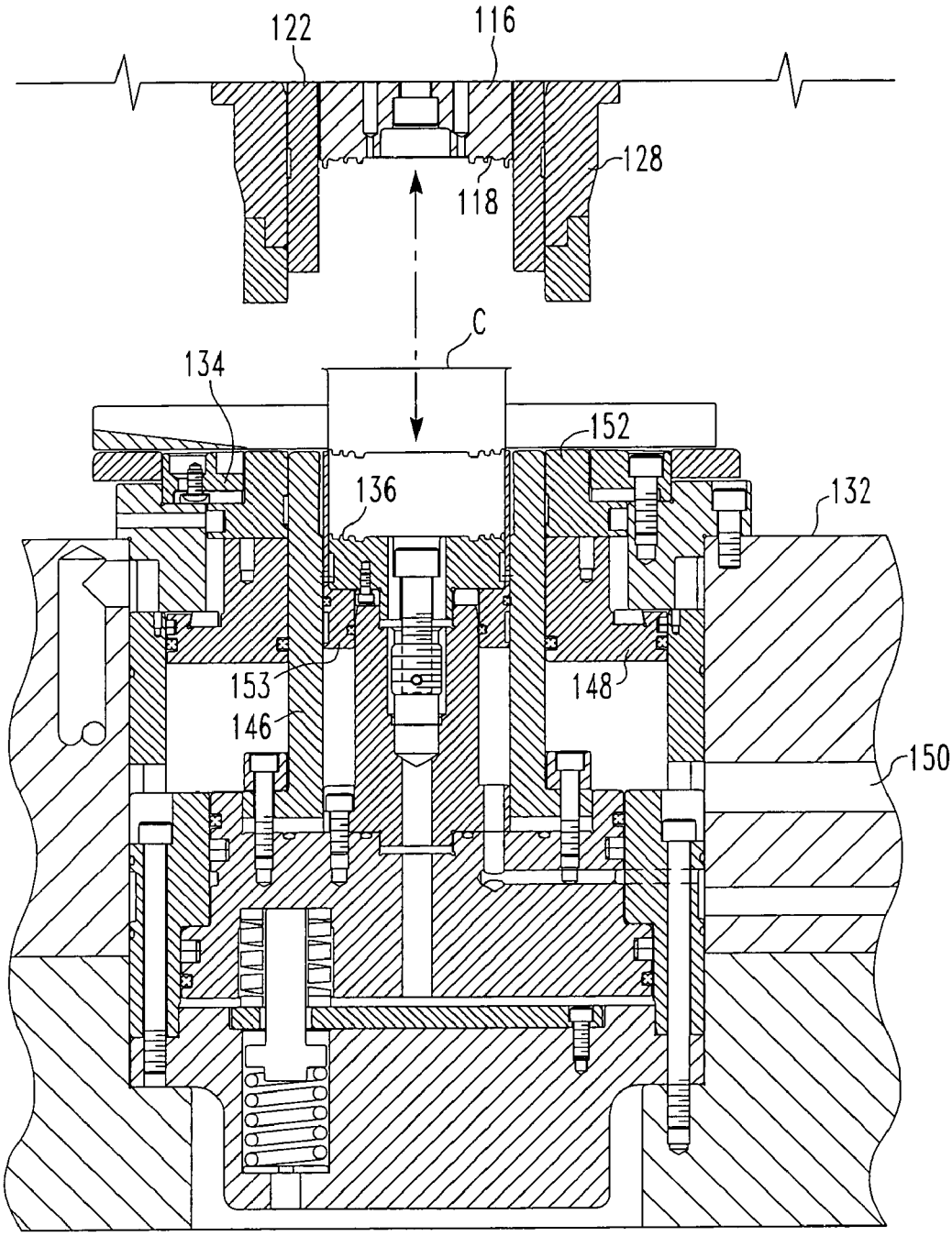
FIG. 13 is an elevational assembly view of an embodiment of a press showing the press after the bottom profiled container has been formed.

With continued reference to FIG. 9, the position of the tooling is shown just prior to blanking of material M within the press 110, while the position of the tooling depicted in FIG. 13 is after formation of a bottom profiled container. The remaining FIGS. 9-13 illustrate the position of the tooling at various stages during the forming process and will be described more completely below.

Referring to FIG. 9, the press 110 generally includes an inner slide holder 112 that is attached to a riser 114, as by screws. The projecting end of the riser 114 carries a punch 116 secured thereto by a screw and which has a profiled bottom surface 118 the punch 116 has a preselected profile and is selectively actuated up and down by movement of the inner slide holder 112.

The outer rim of the press 110 carries an outer slide holder 120, which is arranged generally in concentric relationship with respect to the riser 114 carried by the inner slide holder 112. Surrounding a portion of the riser 114 is a pressure sleeve 122, which is slidably disposed within the outer slide holder 120 and which is disposed beneath an upper piston 124, which is also slidable under fluid or gas pressure through a bore 126 so that pressure acting on the piston 124 will also act on the pressure sleeve 122, as described more completely below. The pressure sleeve 122 is concentrically disposed around the punch 116. The outer slide holder 120 may also carry a blank and draw punch 128 and retainer 130, which may be secured by screws. The blank and draw punch 128 is concentrically disposed around the pressure sleeve 122 with the blank and draw punch 128 being selectively actuated up and down with movement of the outer slide holder 120.

Disposed in opposed relationship to the inner and outer slide holders 112 and 120 of the press 10 is the fixed base 132, which also carries a number of tooling components. The fixed base 132 has a top surface and a bottom surface. For example, a cut edge 134 may be secured to the base 132, as by screws, and cooperates with the blank and draw punch 128 for blanking the material M. Inboard of the cut edge 134 is a profile pad 136 which has a preselected profile located centrally within a die cavity in the fixed base 132. Profile pad 136 is structured to be disposed within the fixed base 132 in opposed relationship to the punch 116. This profile pad 136 is secured to the fixed base 132.

Also arranged concentrically around a portion of the profile pad 136 is a redraw die 146. The redraw die 146 sits in opposed relationship to the pressure sleeve 122. Concentrically arranged around the redraw die 146 and located beneath the cut edge 134 is a lower piston 148 that is actuated by a source of high pressure fluid or gas through a bore 150. Supported on top of this lower piston 148 is a draw pad 152 concentrically disposed around the redraw die 146 that cooperates with the blank and draw punch 128, as described more completely below. Draw pad 152 sits in opposed relationship to the blank and draw punch 128.

Turning to FIGS. 9-13, operation of the press 110 will now be described. Material M may be fed into the opening of the press 110 in the form of either sheet or coil stock and is in the position of FIG. 9 just prior to blanking. During this period, the profile pad 136 is located beneath the tin line (the plane defined by the material M, as it is initially fed into the press) which avoids premature profiling of the container C.

At this time, the inner and outer slide holders 112 and 120 descend toward the base 132. Soon thereafter, blank and draw punch 128 contacts the material M, as has the pressure sleeve 122, under the force of piston 124. The blank and draw punch 128 and the pressure sleeve 122 cooperate with the draw pad 152 and the redraw die 146 to begin forming an inverted container IC from the material M. At this point, the lower piston 148 is in an elevated position, such that the draw pad 152 supports the material M beneath the blank and draw punch 128. The fixed redraw die 146 is also in a supporting relationship with the material M.

Figure 10:
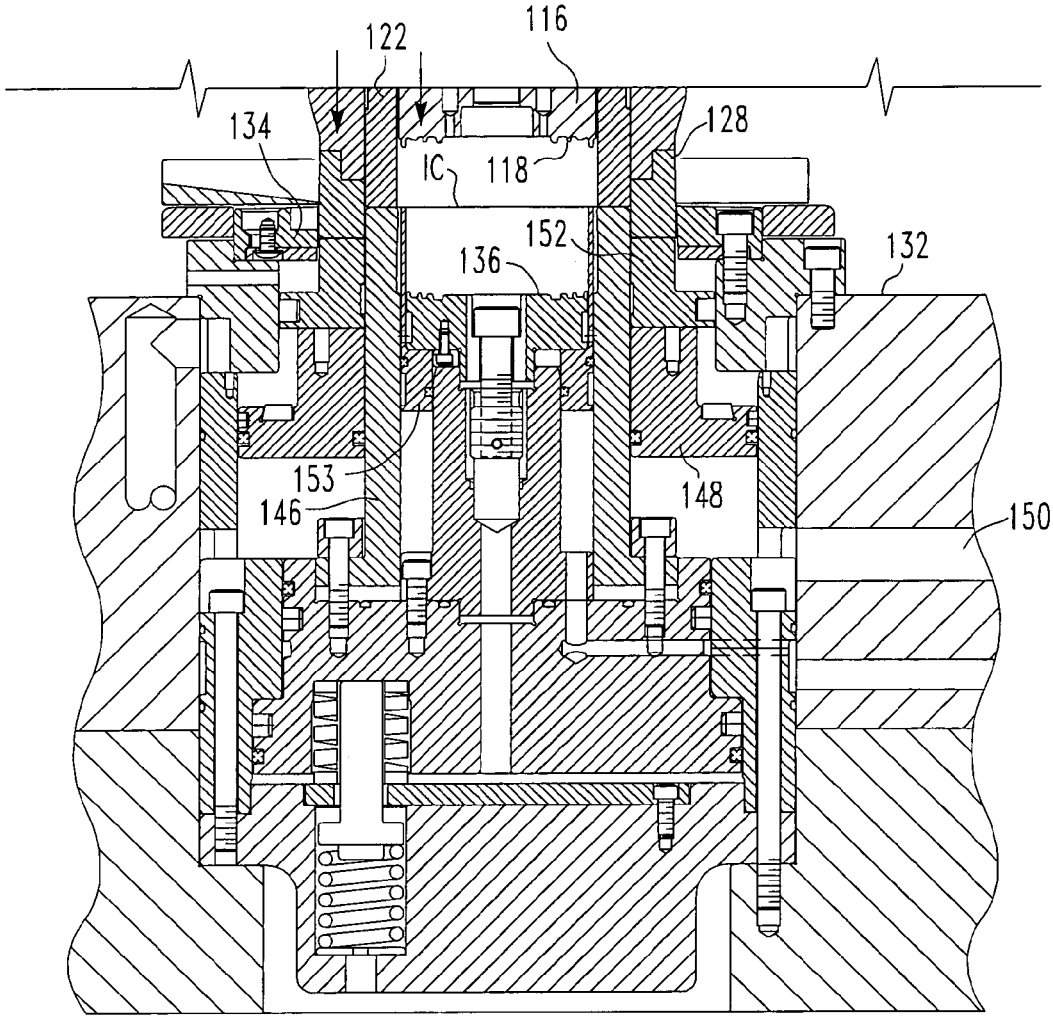
FIG. 10 is an elevational assembly view of an embodiment of a press showing the press following blanking of the material and forming an inverted container.

Further downward movement of the slide holders 112 and 120 moves the tooling from the position depicted in FIG. 9 to that of FIG. 10 to first blank the material M and form an inverted container IC, as will be described below. To perform blanking, the blank and draw punch 128 severs the material M against the cut edge 134 during its descent. Then, continued downward movement of the blank and draw punch 128 wipes the periphery of the blank of material M about the top of the redraw die 146 to form an inverted container IC, as shown in FIG. 10. At this point, the profile pad 136 is located below the center of the inverted container IC.

Figure 11:
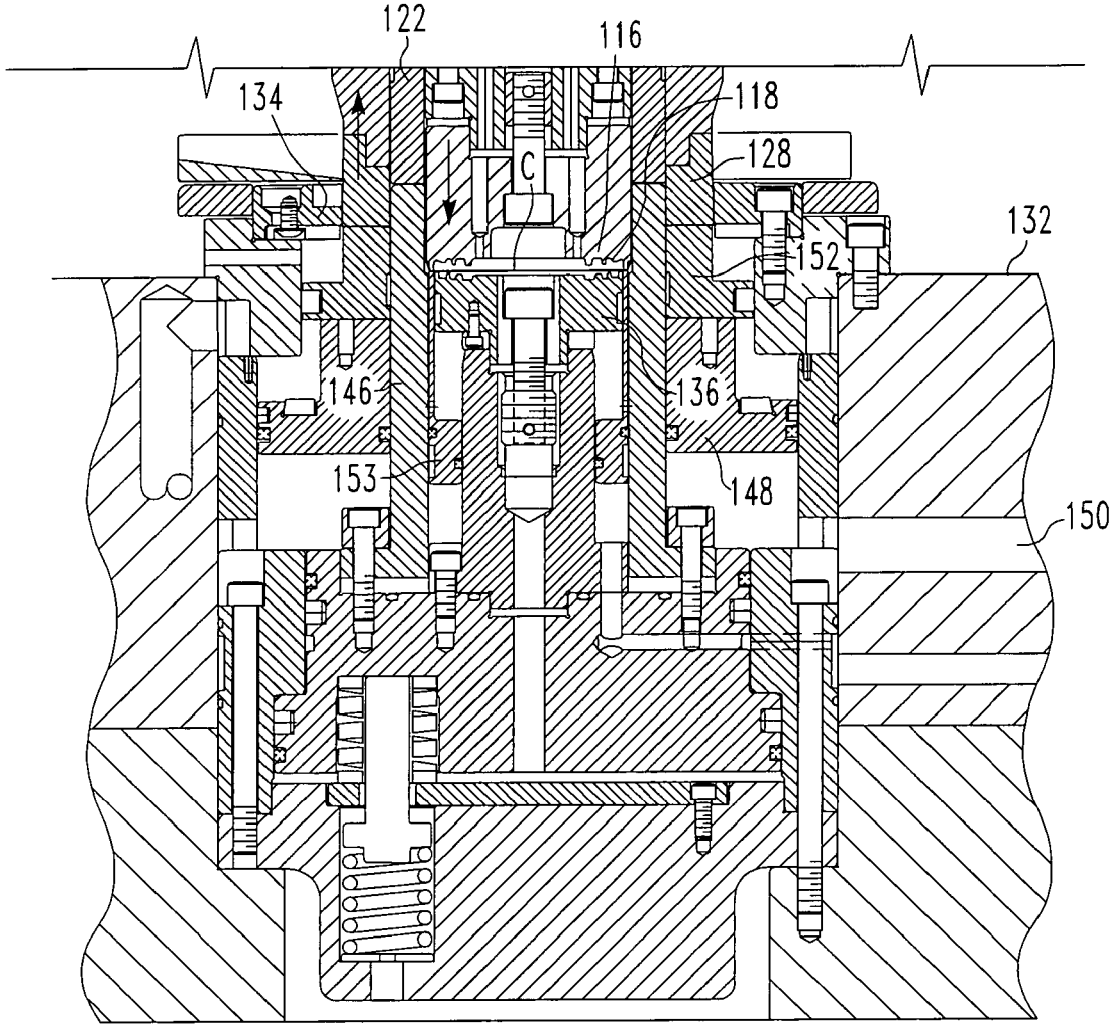
FIG. 11 is an elevational assembly view of an embodiment of a press showing the press reverse drawing the inverted container and forming a container.

Continued downward movement of the slides 112 and 120 moves the tooling from the position of FIG. 10 to the position of FIG. 11 to initiate redraw and inversion of the inverted container IC. At this point, the profile pad 136 is not yet profiling the container. The high points on the bottom of the punch 116 and top of profile pad 136 will eventually contact the material M and the punch 116 will force a knockout ring 153 down and continue the reverse draw of the inverted container IC to form container C. Between FIGS. 10 and 11, the movement of the inner slide pulls the material M over the top of the redraw die 146 to effectively turn the previously formed inverted container IC inside out to form container C. During the reverse draw, downward movement of the punch 116 eventually causes the punch 116 to reach a point where the bottom of the container C is initially profiled by the profile pad 136. Continued movement of the slide 112 toward the fixed base 132 forces the punch 116 downward against the material M in the bottom of the container C to impart the desired contour to the bottom, as shown in FIG. 12. It will be appreciated that this profile is dictated by the complementary configuration of the punch 116 and profile pad 136.

Comparing the positions depicted in FIGS. 11 and 12, it will be noted that between these positions, the outer slide holder 120 reaches bottom dead center and begins to retract. The blank and draw punch 128 begins to pull away from the fixed base 132, while the inner slide 112 continues downward movement of the punch 116 against the profile pad 136. This movement completes the reverse draw of the container C and sets the bottom profile.

When using the knockout ring 153, the downward movement of punch 116 compress the spring loaded or air supported knockout ring 153. Movement of slide 120 causes the blank and draw punch 128 to force the draw pad 152 and piston 148 downward overcoming the fluid, gas or mechanical pressure beneath piston 148. At this point, a container C has been formed and the bottom profile has been imparted to the container C as shown in FIG. 12. After the container C has been formed in the redraw process and the bottom profile has been set, the punch tooling begins to move upward and the container C is raised to the tin line by the knockout ring 153 after the punch 116 clears from the container C as can be seen in FIG. 13. After the container C is ejected, the press 110 may repeat the entire process for forming additional containers C.

It has found that in operating the press 110, the tooling, and, particularly, the profile pad 136 or the punch 116 and the profile pad 136 and the redraw die 146 or the pressure sleeve 122 and the redraw die 146, expands, as the press 110 heats up. This expansion causes the tolerances between the punch 116 and the profile pad 136, the pressure sleeve 122 and the redraw die 146 to fall outside of specification, which often results in variations in the height of the bottom profile and the height of the sidewall of the container C. One variation that can occur is a deepening of the bottom profile and the sidewall. As will be appreciated, such deepening can result in a weakened container C that must be scrapped.

In view of this fact, press 110 may optionally include an expansion assembly generally indicated by numeral 162 in FIG. 9. In general, expansion assembly 162 includes a biasing member 164 that compress to the extent necessary to offset any thermal expansion of the profile pad 136 or the punch 116 and the profile pad 136 and the redraw die 146 or the pressure sleeve 122 and the redraw die 146. While biasing member 164 is depicted in FIGS. 9-13 a spring, one of ordinary skill in the art would recognize that biasing member 164 could be elastomeric components or any other components that can be compressed. Biasing member 164 may supportingly contact the profile pad 136 and the redraw die 146. While biasing member 164 may directly engage the profile pad 136 and the redraw die 146, the biasing member 164 may be situated below the profile pad 136, the redraw die 146 and/or the draw pad 152 for a more convenient placement of the biasing member 164 out of the way of the moving components. One or more vents may be provided adjacent to the biasing member 164 for venting purposes. Biasing member 164 extends axially upwardly and provides a clearance between various press components. Biasing member 166 provides support to biasing member 164.

As operation of the press 10 continues and the tooling heats up, in response to the greater extension of the profile pad 136 or the punch 116 and the profile pad 136 and the redraw die 146 or the pressure sleeve 122 and the redraw die 146, the profile pad 136 and the redraw die 146 compresses biasing member 164 to the extent that the punch 116 and the profile pad 136, the pressure sleeve 122 and the redraw die 146 exceed their ordinary tolerances. In this way, the tolerance between the punch 116 and the profile pad 136 and the pressure sleeve 122 and the redraw die 146 is maintained avoiding any defect in the profile and sidewall of the container C. While expansion assembly 162 is shown in use with a press 110 that has a profile pad 136 that is secured to a fixed base, one of ordinary skill in the art would recognize that expansion assembly 162 could be used in a press 10 that employs the use of a profile pad 36 that is secured to a movable die core riser 38 of the type shown in FIGS. 1-7 of this patent application.

It should also be noted that the presses 10, 110 of the present invention also allow for the simplified removal of tool packs 168, 170 from the top surfaces of the fixed bases 32, 132. In the prior art, the operator of the presses 10, 110 had to remove tooling components from the bottom surfaces of the fixed bases 32, 132. As can be appreciated, a mechanic had to climb under presses 10, 110 in order to remove certain tooling components in an inefficient, potentially hazardous and time consuming process. In the press 10 depicted in FIG. 1, the tool pack 168 which is located within a part of the fixed base 32 and above the bolster plate 172 may be removed from the top surface of the fixed base 32 except for the die core riser 38. For example, the tool pack 168 may consist of the cut edge 34, the draw pad 52, the redraw die 46, the profile pad 36, the lower piston 48 and the annular ring component located below the profile pad 36 and the redraw die 46. All of these components may be efficiently removed from the top surface of the fixed base 32.

Also, in the press depicted in FIG. 9, the tool pack 170 which is located within a part of the fixed base 132 may be removed from the top surface of the fixed base 132. For example, the tool pack 170 may consist of the cut edge 134, the draw pad 152, the redraw die 146, the profile pad 136, the knockout ring 153, the lower piston 148, the expansion assembly 162 and the remaining components set within the fixed base 132. All of these components may be efficiently removed from the top surface of the fixed base 132. As can be appreciated, the removability of the tool packs 168, 170 from the top surfaces of the fixed bases 32, 132 provides the end-user of the presses 10, 110 with easier access to the tooling components which must be repaired or replaced from time to time due to ordinary wear and tear.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereof.

What is claimed is:

1. A press for forming a container with a bottom profile having a preselected height and a sidewall having a preselected height from a supply of material entering the press at a forming station, the press comprising:

a punch with a preselected profile secured to the press which is selectively actuated up and down by movement of the press;

a pressure sleeve concentrically slidably disposed around the punch;

a blank and draw punch secured to the press which is concentrically disposed around the pressure sleeve with the blank and draw punch being selectively actuated up and down by movement of the press;

a fixed base having a top surface and a bottom surface;

a die core riser supported within the fixed base which is axially movable within the base;

a profile pad with a preselected profile secured to an end of the die core riser with the profile pad being structured to be disposed within the fixed base in opposed relationship to the punch;

a redraw die concentrically disposed around a portion of the profile pad in opposed relationship to the pressure sleeve;

a draw pad concentrically slidably disposed around the redraw die in opposed relationship to the blank and draw punch;

a cut edge located adjacent to the draw pad;

a piston operatively connected to the die core riser;

a cylinder disposed below the base which houses the piston;

a first passage communicating with the cylinder above the piston and a second passage communicating with the cylinder below the piston, the passages being connected to a fluid or gas supply to selectively pressurize the cylinder on at least one side of the piston, whereby the passages selectively control movement of the profile pad up and down through movement of the die core riser up and down for the profile pad to selectively form the bottom profile in the container in cooperation with the punch;

a biasing member located in the base structured to accommodate expansion in at least one of the profile pad and the punch and in at least one of the redraw die and the pressure sleeve during operation of the press;

wherein the blank and draw punch is structured to blank the material against the cut edge and draw the material into an inverted container by wiping the material over the redraw die during descent of the blank and draw punch while the pressure sleeve and redraw die hold the material between the pressure sleeve and the redraw die;

wherein the punch is structured to redraw the inverted container into a container by pulling the inverted container over the redraw die during descent of the punch;

wherein the profiled punch and the profile pad are structured to cooperate with each other to form the bottom profile of the container; and wherein the biasing member located in the base is compressed as the at least one of the profile pad and the punch and the at least one of the redraw die and the pressure sleeve expand due to heat generated by the press during operation of the press in order to control the height of the bottom profile and the height of the sidewall of the container.

2. The press of claim 1 wherein the biasing member comprises a first biasing member located in the base structured to accommodate expansion in at least one of the profile pad and the punch during operation of the press; and a second biasing member located in the base structured to accommodate expansion in at least one of the redraw die and the pressure sleeve during operation of the press;

wherein the first biasing member located in the base is compressed as the at least one of the profile pad and the punch expand due to heat generated by the press during operation of the press in order to control the height of the bottom profile; and wherein the second biasing member located in the base is compressed as the at least one of the redraw die and the pressure sleeve expand due to heat generated by the press during operation of the press in order to control the height of the sidewall of the container.

3. The press of claim 1 further comprising a tool pack of tool components located within a part of the fixed base wherein the tool pack is removable from the top surface of the base.

4. The press of claim 1 wherein the punch and the profile pad have one of a preselected flattened annular projection and a preselected flattened annular shoulder and the projection and the shoulder are structured to clamp the material between the projection and the shoulder and allow the material to roll up a preselected height into the container in a controlled manner to form the bottom profile of the container.

5. A press for forming a container with a bottom profile having a preselected height and a sidewall having a preselected height from a supply of material entering the press at a forming station, the press comprising:

a punch with a preselected profile secured to the press which is selectively actuated up and down by movement of the press;

a pressure sleeve concentrically slidably disposed around the punch;

a blank and draw punch secured to the press which is concentrically disposed around the pressure sleeve with the blank and draw punch being selectively actuated up and down by movement of the press;

a fixed base having a top surface and a bottom surface;

a profile pad with a preselected profile structured to be disposed within the fixed base in opposed relationship to the punch;

a redraw die concentrically disposed around a portion of the profile pad in opposed relationship to the pressure sleeve;

a draw pad concentrically slidably disposed around the redraw die in opposed relationship to the blank and draw punch;

a cut edge located adjacent to the draw pad;

a first biasing member located in the base structured to accommodate expansion in at least one of the profile pad and the punch during operation of the press; and a second biasing member located in the base structured to accommodate expansion in at least one of the redraw die and the pressure sleeve during operation of the press;

wherein the blank and draw punch is structured to blank the material against the cut edge and draw the material into an inverted container by wiping the material over the redraw die during descent of the blank and draw punch while the pressure sleeve and redraw die hold the material between the pressure sleeve and the redraw die;

wherein the punch is structured to redraw the inverted container into a container by pulling the inverted container over the redraw die during descent of the punch;

wherein the profiled punch and the profile pad are structured to cooperate with each other to form the bottom profile of the container;

wherein the first biasing member located in the base is compressed as the at least one of the profile pad and the punch expand due to heat generated by the press during operation of the press in order to control the height of the bottom profile; and wherein the second biasing member located in the base is compressed as the at least one of the redraw die and the pressure sleeve expand due to heat generated by the press during operation of the press in order to control the height of the sidewall of the container.

6. The press of claim 5 wherein the profile pad is secured within the base.

7. The press of claim 5 wherein the profile pad is secured to a die core riser and is axially movable up and down.

8. The press of claim 5 further comprising a tool pack of tool components located within a part of the fixed base wherein the tool pack is removable from the top surface of the base.

9. The press of claim 5 wherein the punch and the profile pad have one of a preselected flattened annular projection and a preselected flattened annular shoulder and the projection and the shoulder are structured to clamp the material between the projection and the shoulder and allow the material to roll up a preselected height into the container in a controlled manner to form the bottom profile of the container.

10. A press for forming a container with a bottom profile having a preselected height and a sidewall having a preselected height from a supply of material entering the press at a forming station, the press comprising:

a punch with a preselected profile secured to the press which is selectively actuated up and down by movement of the press;

a pressure sleeve concentrically slidably disposed around the punch;

a blank and draw punch secured to the press which is concentrically disposed around the pressure sleeve with the blank and draw punch being selectively actuated up and down by movement of the press;

a fixed base having a top surface and a bottom surface;

a profile pad with a preselected profile structured to be disposed within the fixed base in opposed relationship to the punch;

a redraw die concentrically disposed around a portion of the profile pad in opposed relationship to the pressure sleeve;

a draw pad concentrically slidably disposed around the redraw die in opposed relationship to the blank and draw punch;

a cut edge located adjacent to the draw pad; and a biasing member located in the base structured to accommodate expansion in at least one of the profile pad and the punch and in at least one of the redraw die and the pressure sleeve during operation of the press;

wherein the blank and draw punch is structured to blank the material against the cut edge and draw the material into an inverted container by wiping the material over the redraw die during descent of the blank and draw punch while the pressure sleeve and redraw die hold the material between the pressure sleeve and the redraw die;

wherein the punch is structured to redraw the inverted container into a container by pulling the inverted container over the redraw die during descent of the punch;

wherein the profiled punch and the profile pad are structured to cooperate with each other to form the bottom profile of the container;

wherein the punch and the profile pad have one of a preselected flattened annular projection and a preselected flattened annular shoulder;

wherein the projection and the shoulder are structured to clamp the material between the projection and the shoulder and allow the material to roll up a preselected height into the container in a controlled manner to form the bottom profile of the container; and wherein the biasing member located in the base is compressed as the at least one of the profile pad and the punch and the at least one of the redraw die and the pressure sleeve expand due to heat generated by the press during operation of the press in order to control the height of the bottom profile and the height of the sidewall of the container.

11. The press of claim 10 wherein the biasing member comprises;

a first biasing member located in the base structured to accommodate expansion in at least one of the profile pad and the punch during operation of the press and; and a second biasing member located in the base structured to accommodate expansion in at least one of the redraw die and the pressure sleeve during operation of the press;

wherein the first biasing member located in the base is compressed as the profile pad or at least one of the profile pad and the punch expand due to heat generated by the press during operation of the press in order to control the height of the bottom profile; and wherein the second biasing member located in the base is compressed as the redraw die or at least one of the redraw die and the pressure sleeve expand due to heat generated by the press during operation of the press in order to control the height of the sidewall of the container.

12. The press of claim 10 wherein the profile pad is secured within the base.

13. The press of claim 10 wherein the profile pad is secured to a die core riser and is axially movable up and down.

14. The press of claim 10 further comprising a tool pack of tool components located within a part of the fixed base wherein the tool pack is removable from the top surface of the base.

15. A press for forming a container with a bottom profile having a preselected height and a sidewall having a preselected height from a supply of material entering the press at a forming station, the press comprising:

a punch with a preselected profile secured to the press which is selectively actuated up and down by movement of the press;

a pressure sleeve concentrically slidably disposed around the punch;

a blank and draw punch secured to the press which is concentrically disposed around the pressure sleeve with the blank and draw punch being selectively actuated up and down by movement of the press;

a fixed base having a top surface and a bottom surface;

a profile pad with a preselected profile structured to be disposed within the fixed base in opposed relationship to the punch;

a redraw die concentrically disposed around a portion of the profile pad in opposed relationship to the pressure sleeve;

a draw pad concentrically slidably disposed around the redraw die in opposed relationship to the blank and draw punch;

a cut edge located adjacent to the draw pad;

a tool pack of tool components located within a part of the fixed base; and a biasing member located in the base structured to accommodate expansion in at least one of the profile pad and the punch and in at least one of the redraw die and the pressure sleeve during operation of the press;

wherein the blank and draw punch is structured to blank the material against the cut edge and draw the material into an inverted container by wiping the material over the redraw die during descent of the blank and draw punch while the pressure sleeve and redraw die hold the material between the pressure sleeve and the redraw die;

wherein the punch is structured to redraw the inverted container into a container by pulling the inverted container over the redraw die during descent of the punch;

wherein the profiled punch and the profile pad are structured to cooperate with each other to form the bottom profile of the container;

wherein the tool pack is removable from the top surface of the base; and wherein the biasing member located in the base is compressed as the at least one of the profile pad and the punch and the at least one of the redraw die and the pressure sleeve expand due to heat generated by the press during operation of the press in order to control the height of the bottom profile and the height of the sidewall of the container.

16. The press of claim 15 wherein the biasing member comprises:

a first biasing member located in the base structured to accommodate expansion in at least one of the profile pad and the punch during operation of the press; and a second biasing member located in the base structured to accommodate expansion in at least one of the redraw die and the pressure sleeve during operation of the press;

wherein the first biasing member located in the base is compressed as the at least one of the profile pad and the punch expand due to heat generated by the press during operation of the press in order to control the height of the bottom profile; and wherein the second biasing member located in the base is compressed as the at least one of the redraw die and the pressure sleeve expand due to heat generated by the press during operation of the press in order to control the height of the sidewall of the container.

17. The press of claim 15 wherein the profile pad is secured within the base.

18. The press of claim 15 wherein the profile pad is secured to a die core riser and is axially movable up and down.

19. The press of claim 15 wherein the punch and the profile pad have one of a preselected flattened annular projection and a preselected flattened annular shoulder and the projection and the shoulder are structured to clamp the material between the projection and the shoulder and allow the material to roll up a preselected height into the container in a controlled manner to form the bottom profile of the container.

* * * * *